United States Patent [19]

Fletcher et al.

[11] 3,937,661

[45] Feb. 10, 1976

[54] METHOD AND APPARATUS FOR FLUFFING, SEPARATING, AND CLEANING FIBERS

[76] Inventors: James C. Fletcher, Administrator of the National Aeronautics and Space Administration, with respect to an invention of Dan Padilla, Littleton, Colo.

[22] Filed: Mar. 12, 1974

[21] Appl. No.: 450,502

[52] U.S. Cl. ..... 209/250; 19/205; 134/21; 134/37; 209/300; 209/305

[51] Int. Cl.[2] ..... B07B 7/12

[58] Field of Search ..... 134/21, 37; 19/200, 205; 15/306 R, 306 B, 345, 404; 162/218, 220, 402, 404, 406; 209/250, 300, 305, 306

[56] References Cited

UNITED STATES PATENTS

| | | | |
|---|---|---|---|
| 1,077,947 | 11/1913 | Abrames et al. | 209/300 |
| 3,466,695 | 9/1969 | McCallister et al. | 15/306 R |
| 3,686,070 | 8/1972 | Williams | 162/406 X |

*Primary Examiner*—S. Leon Bashore
*Assistant Examiner*—Richard V. Fisher
*Attorney, Agent, or Firm*—Howard J. Osborn; John R. Manning

[57] ABSTRACT

A perforated tube is housed in a chamber in which vacuum is drawn. An air jet is directed into one end of the tube and fiber bundles are fed into the jet which separates and dispenses individual fibers from the bundle, fluffs them, cleanses them of any particulate material, and carries them into the tube. The tube retains the fibers while fiber fragments, undesirably short fibers and particulate matter are drawn by the vacuum and resultant air flow out of the tube through its perforations to a suitable discharge.

9 Claims, 3 Drawing Figures

METHOD AND APPARATUS FOR FLUFFING, SEPARATING, AND CLEANING FIBERS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention is in the field of fiber dispersing and cleansing.

The use of fibrous materials for reinforcements in other materials is well-known but it is desirable that the fibers be free of foreign matter, be of substantial length for maximum reinforcement, and that they be separate rather than entwined in bundles or the like. Before such fibers can be used in their intended environment, they must be separated and have foreign matter removed and heretofore it has been done by complicated or expensive machinery or by hand.

SUMMARY OF THE INVENTION

The present invention provides a simple and inexpensive method and apparatus for separating fibers from bundles thereof and for removing foreign matter and short fibers while accumulating the desired fibers in a fluffed condition for ready retrieval. In general, the invention comprises feeding the bundles of fibers into a jet of air which is directed into a perforated tube and wherein at least a partial vacuum exists exteriorally of the tube. The jet of air separates the individual fibers from the bundle and air flow through the tube perforations to the outside thereof carries with it contaminating particles and undesirably short fibers which are withdrawn by the source of vacuum to a suitable disposal. The separated fibers are retained in the perforated tube which serves as a container or package thereof that may be withdrawn for use when full.

DESCRIPTION OF A PREFERRED EMBODIMENT

Figure 1:
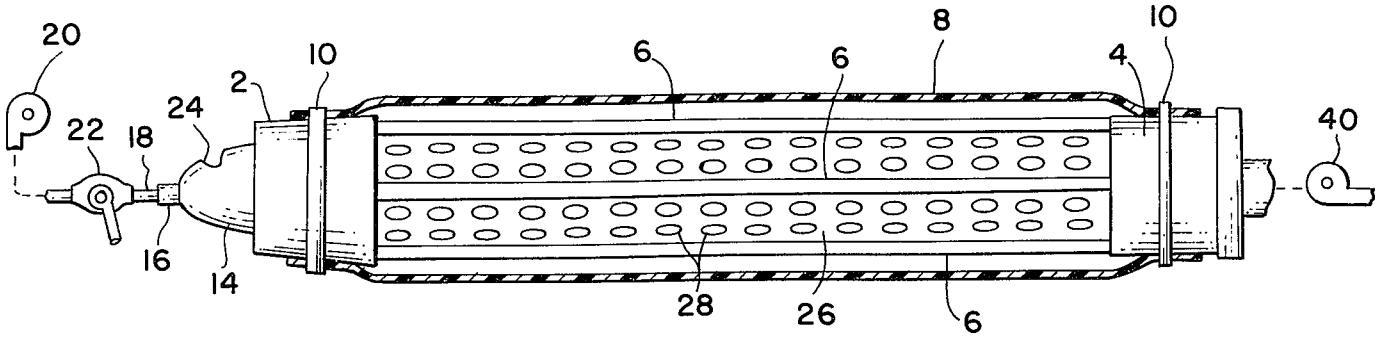
FIG. 1 is a side elevational view of apparatus embodying the present invention with certain parts thereof being shown in section.
Figure 3:
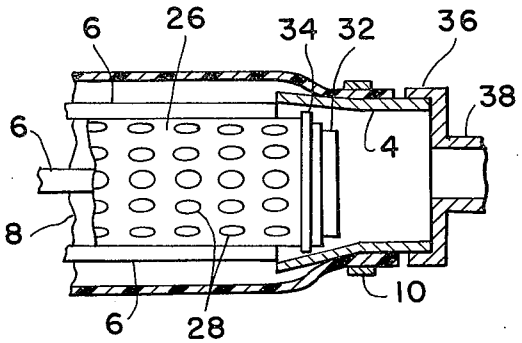
FIG. 3 is a fragmentary longitudinal sectional view through the other end of the apparatus of FIG. 1, with certain parts therein being shown in elevation.
Figure 2:
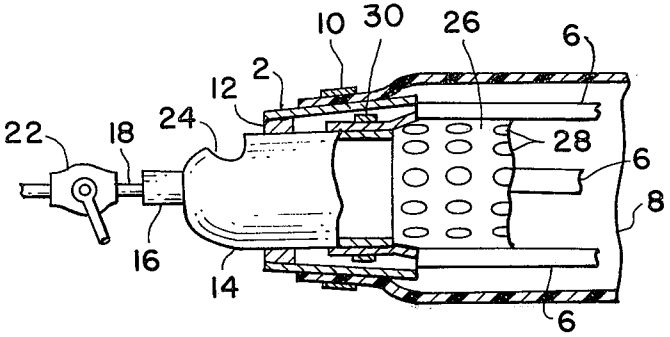
FIG. 2 is a fragmentary longitudinal sectional view through one end of the apparatus of FIG. 1, with portions thereof being shown in elevation.

Referring now to the drawings there is shown a housing assembly comprising annular end members 2 and 4 held in spaced relation by longitudinal ribs or frame members 6 that are spaced apart as shown and suitably secured to the end members 2 and 4 to define a skeletal framework. A flexible air-impervious tubular member 8 surrounds the described frame member, and its ends are sealingly connected to the annular members 2 and 4 by means of bands 10, which may be elastic or may be in the form of tape or any other suitable means. Thus, the assembly described comprises a housing having an air-impervious outer surface which is preferably transparent whereby the interior of the device may be observed while in operation. The tubular member 8 may suitably be of polyethylene although it may be of any rigid material also.

Within the outer end of the annular member 2, there is a spacing and sealing ring 12 which may be secured to the member 2 or to a fitting, all as will be described.

A generally bell-shaped fitting 14 extends through the ring 12 and is open at its inner end within the described housing while its outer end is provided with a fitting 16 adapted to receive a nozzle or the like 18 for directing a jet of air into the fitting. A suitable source of compressed air schematically shown at 20 is connected through a valve 22 to the nozzle 18. Also, outside the described housing the fitting 14 is provided with an opening 24 through which bundles or other masses of fibers may be introduced into the fitting to be entrained by the jet of air issuing from the nozzle 18. The fitting 14 extends quite snugly through the ring 12 which may be either secured to the fitting or secured to annular member 2 and slidable over the fitting, as will be referred to later.

A perforated tube 26 provided with a multiplicity of perforations 28 encompasses the inner end of the fitting 14 and is removably secured thereto by any suitable means, such as the band 30. The tube 26 may suitably be of perforated Teflon. The perforated tube 26 extends longitudinally through the housing to or into the annular member 4 at the other end thereof but is of less diameter than the inner diameter of the member 4. At that other end the perforated tube 26 is provided with a suitable closure 32, which is shown merely as a plug held in place by a band 34. Preferably, the perforated tube 26 is a flexible tubular material cut from a long length thereof, thus necessitating the use of plug 32 or its equivalent. Obviously, however, any suitable closure means may be provided at the right hand end of tube 26 and may even be an integrally closed end thereof. Also, the tube 26 may be rigid, although it is preferred that it be of flexible material.

At its right hand end the apparatus is provided with a cap 36 embracing annular member 4 and having a tubular boss 38 thereon, suitably connected to a source of vacuum, such as the pump schematically shown at 40.

In operation, the parts are assembled as shown and when valve 22 is opened nozzle 18 directs a high velocity jet of air into the fitting 14 and longitudinally within the perforated tube 26. As bundles or masses of fibers are fed through opening 24, the bundles of fibers are literally blasted apart and fibers are individually entrained in the jet of air, pulled from the bundle or mass and the air separates any particulate matter from the fibers. All of that material is blown into the perforated tube 26. However, the region outside the tube 26 is under at least partial vacuum due to the connections to the vacuum source 40 and there is a constant and substantial flow of air outwardly through the perforations 28. That air carries with it undesired particulate matter and fiber fragments or fibers of less length than those desired, which is determined by the size of the perforations 28. The separated longer fibers are retained and accumulated within the tube 26 in a fluffed and cleansed condition. When the desired mass of fibers has thus been accumulated or when the tube 26 becomes full, the valve 22 may be closed and thereafter the source of vacuum disconnected or shut down. As shown, the cap 36 removably embraces the outer end of annular member 4 and can be retained thereon by any suitable means, such as screw threads, not shown.

In any event, the cap may be made removable and ring 12 secured to end member 2 so that the assembly of the perforated tube 26 and fitting 14 may be withdrawn from nozzle 18, through ring 12 and from the housing whereupon the tube 26 may be removed from the fitting 14 and then constitutes a container or bag of the desired fibers. A second perforated tube may then be adapted to the fitting 14 and the parts reassembled, as shown, for a further cycle of operation. On the other hand the fibers may be emptied from the tube 26 and the same tube replaced for the next cycle of operation. As an alternative, the cap 36 may be permanently secured to the annular member 4, in which case the ring 12 is preferably secured to the fitting 14 and the assembly of ring 12, fitting 14 and tube 26 may be withdrawn outwardly through the annular member 2. This could be accomplished without disconnecting the fitting 14 from nozzle 18.

While a single specific embodiment of the invention has been shown and described, it is to be understood that the same is merely exemplary of the principles involved and that other embodiments may be included within the scope of the appended claims.

I claim:

1. Apparatus for fluffing, separating and cleaning fibers from fiber fragments and particulate matter comprising:

an elongated perforated tube, closed at one end and having means for directing a jet of air axially into the other end;

means for directing fibrous material into said air jet at said other end whereby said fibrous material is entrained by said jet and carried into said perforated tube; said fibrous material being directed into said air jet along a line which is not parallel to said air jet;

housing means spaced from but enclosing said perforated tube; and means for withdrawing air from said housing means exteriorly of said tube whereby the fibers of said fibrous material are fluffed and separated from each other and from particulate matter as they enter said air jet, said fibers being retained in said tube and said particulate matter and fiber fragments being drawn outwardly of said perforated tube and housing by said last-named means.

2. Apparatus as defined in claim 1 wherein said perforated tube has associated therewith means enabling ready removal thereof from said housing whereby said tube and its contained fibers may be removed from said housing.

3. Apparatus as defined in claim 1 wherein said housing comprises a skeletal framework having a transparent air impervious tubular member thereover.

4. Apparatus as defined in claim 1 wherein said perforated tube is of flexible sheet material and said means for directing said air jet comprises a tubular fitting having one end portion removably secured to said other end of said tube and having an inlet means connected to a means for supplying air under pressure.

5. Apparatus as defined in claim 4 wherein said tubular fitting extends through a means defining an opening in said housing and wherein said means for directing said fibrous material into said air jet includes a means defining an opening in said tubular fitting outwardly of said housing.

6. The method of fluffing, separating and cleaning fibers from fiber fragments and particulate matter comprising the steps of: providing a perforated tube enclosed by a housing spaced from said perforated tube;

directing a jet of air into said perforated tube;

directing said fibrous material into said jet in the region where said jet enters said perforated tube whereby said jet entrains and fluffs and separates the same from said fiber fragments and cleanses the same of particulate matter; said fibrous material being directed into said air jet along a line which is not parallel to said air jet; and confining and accumulating said fluffed and separated and cleansed fibers in said perforated tube while withdrawing air, said particulate matter and said fiber fragments from said perforated tube into the space between said housing and said perforated tube.

7. The method as defined in claim 6 wherein said step of confining said fibers to said perforated tube is performed by providing said perforated tube with perforation means pervious to air, the particulate matter and the fiber fragments but impervious to said fibers.

8. The method defined in claim 7 wherein said withdrawing step is performed by establishing and maintaining at least a partial vacuum in the space between said housing and said perforated tube.

9. The method defined in claim 8 wherein said vacuum is established and maintained by constantly withdrawing air, said particulate matter and said fiber fragments from the space between said housing and said perforated tube.

* * * * *